US009039133B2

(12) United States Patent
Nakanishi

(10) Patent No.: US 9,039,133 B2
(45) Date of Patent: May 26, 2015

(54) INK JET PRINTING APPARATUS

(71) Applicant: CANON FINETECH INC., Misato-shi (JP)

(72) Inventor: Yuta Nakanishi, Moriya (JP)

(73) Assignee: CANON FINETECH INC., Misato-shi (JP)

( * ) Notice: Subject to any disclaimer, the term of this patent is extended or adjusted under 35 U.S.C. 154(b) by 0 days.

(21) Appl. No.: 13/867,455

(22) Filed: Apr. 22, 2013

(65) Prior Publication Data

US 2014/0198153 A1 Jul. 17, 2014

(30) Foreign Application Priority Data

Jan. 17, 2013 (JP) ..... 2013-006277

(51) Int. Cl.
*B41J 2/165* (2006.01)

(52) U.S. Cl.
CPC ..... *B41J 2/16508* (2013.01); *B41J 2/16585* (2013.01); *B41J 2002/16591* (2013.01)

(58) Field of Classification Search
USPC ..... 347/29–30
See application file for complete search history.

(56) References Cited

U.S. PATENT DOCUMENTS

| | | | | |
|---|---|---|---|---|
| 5,625,385 | A | 4/1997 | Suzuki | |
| 6,062,670 | A | 5/2000 | Iwata et al. | |
| 2004/0141023 | A1* | 7/2004 | Nakamura | 347/30 |
| 2005/0024422 | A1* | 2/2005 | Danzuka | 347/29 |
| 2006/0132533 | A1* | 6/2006 | Mochizuki | 347/30 |
| 2007/0195122 | A1* | 8/2007 | Hiruma et al. | 347/29 |
| 2011/0050798 | A1* | 3/2011 | Shindo et al. | 347/30 |
| 2011/0085005 | A1* | 4/2011 | Tanaka | 347/29 |

FOREIGN PATENT DOCUMENTS

| | | | |
|---|---|---|---|
| JP | 05-104730 | A | 4/1993 |
| JP | 6-297721 | A | 10/1994 |
| JP | 7-137282 | A | 5/1995 |
| JP | 11-157103 | A | 6/1999 |
| JP | 2005-205712 | A | 8/2005 |
| JP | 2011-161789 | A | 8/2011 |

OTHER PUBLICATIONS

Japanese Office Action issued in Japanese Patent Application No. 2013-006277, dated Dec. 2, 2014.

* cited by examiner

*Primary Examiner* — Jason Uhlenhake
(74) *Attorney, Agent, or Firm* — Fitzpatrick, Cella, Harper & Scinto

(57) ABSTRACT

An ink jet printing apparatus prints an image by employing a print head capable of ejecting ink from ejection ports. The printing apparatus comprises a cap configured to cover the ejection ports, a valve configured to open and close an atmospheric communicating portion that communicates an inside of the cap and the atmosphere, a suction unit configured to generate a suction force, and a control unit. The control unit performs a first operation where the suction unit applies a first suction force to the inside of the cap in a state where the cap covers the ejection ports and the valve closes the atmospheric communicating portion, and a second operation where the suction unit applies a second suction force, less than the first suction force, to the inside of the cap in a state where the cap covers the ejection ports and the valve opens the atmospheric communicating portion.

11 Claims, 10 Drawing Sheets

| TIME ELAPSED AFTER CAPPING [s] | TEMPERATURE DIFFERENCE (ΔT) [°C] | PUMP STATE |
|---|---|---|
| 0 | 36 | Driven |
| 1 | 33 | Driven |
| 2 | 30 | Driven |
| 3 | 28 | Driven |
| 4 | 26 | Driven |
| 5 | 24 | Driven |
| 6 | 22 | Driven |
| 7 | 20 | Driven |
| 8 | 19 | Driven |
| 9 | 18 | Driven |
| 10 | 17 | Driven |
| 11 | 16 | Driven |
| 12 | 15 | Driven |
| 13 | 14 | Driven |
| 14 | 13 | Driven |
| 15 | 12 | Driven |
| 16 | 11 | Driven |
| 17 | 10 | Halted |
| 18 | 10 | Halted |
| 19 | 10 | Halted |

FIG.10

INK JET PRINTING APPARATUS

BACKGROUND OF THE INVENTION

1. Field of the Invention

The present invention relates to an ink jet printing apparatus that includes a cap for covering the ink ejection ports of a print head.

2. Description of the Related Art

For an ink jet printing apparatus that prints an image by employing an ink ejection print head, a recovery process, such as a suction-based recovery procedure or a preliminary ejection procedure, is performed for the print head in order to maintain a satisfactory print head ink ejection function. The suction-based recovery is a recovery process during which a cap is employed to cover an ejection port face of the print head, wherein ejection ports are formed at the distal ends of ink nozzles (capping), and a suction force is applied to an inside of the cap to move viscous ink, for example, from the nozzles into the cap. The preliminary ejection process is a recovery process during which ink that does not contribute to the printing of an image is ejected through the nozzles of the print head into the cap.

When at a high temperature the print head is covered with the cap, air in the cap becomes inflated, and forces ink in the nozzles backward toward the print head, and thus, meniscuses of ink at the ejection ports of the nozzles may become unstable. In order to remove the inflated air from the inside of the cap, an air release port (atmospheric communication portion) is provided for the cap to release the air from the cap to the atmosphere. In Japanese Patent Laid-Open No. H05-104730(1993), a method is proposed for opening or closing the atmospheric communication portion in accordance with the temperature of the print head.

However, in a case where air in the cap that covers the print head becomes inflated, ink in the cap may be pushed outward to the atmospheric communication portion, and may, moreover, leak outside. Furthermore, in a case where the amount of ink in the cap has been increased, and where ink ejected into the cap for the preliminary ejection has splashed, some ink may enter the atmospheric communication portion, and may also, via the atmospheric communication portion, leak outside.

In Japanese Patent Laid-Open No. H05-104730(1993), no description is provided for the leakage of ink from the atmospheric communication portion to the outside, and a method for coping with such a leakage is not proposed.

SUMMARY OF THE INVENTION

The present invention provides an ink jet printing apparatus that can prevent the leakage of ink to the outside via the atmospheric communication portion of the cap.

In an aspect of the present invention, there is provided an ink jet printing apparatus for printing an image on a printing medium by employing a print head capable of ejecting ink from ejection ports, comprising:

a cap configured to cover the ejection ports;

a valve configured to open and close an atmospheric communicating portion that communicates an inside of the cap and the atmosphere;

a suction unit configured to generate a suction force; and a control unit configured to perform a first operation where the suction unit applies a first suction force to the inside of the cap in a state where the cap covers the ejection ports and the valve closes the atmospheric communicating portion, and a second operation where the suction unit applies a second suction force, less than the first suction force, to the inside of the cap in a state where the cap covers the ejection ports and the valve opens the atmospheric communicating portion.

According to the present invention, since ink is appropriately discharged, by suction, from the atmospheric communication portion that connects the inside and outside of the cap, the leakage of ink from the atmospheric communication portion to the outside can be prevented.

Further features of the present invention will become apparent from the following description of exemplary embodiments (with reference to the attached drawings).

BRIEF DESCRIPTION OF THE DRAWINGS

FIG. 10 is a diagram for explaining an example change in temperature difference during a discharge operation in FIG. 9.

DESCRIPTION OF THE EMBODIMENTS (First Embodiment)

Figure 1:
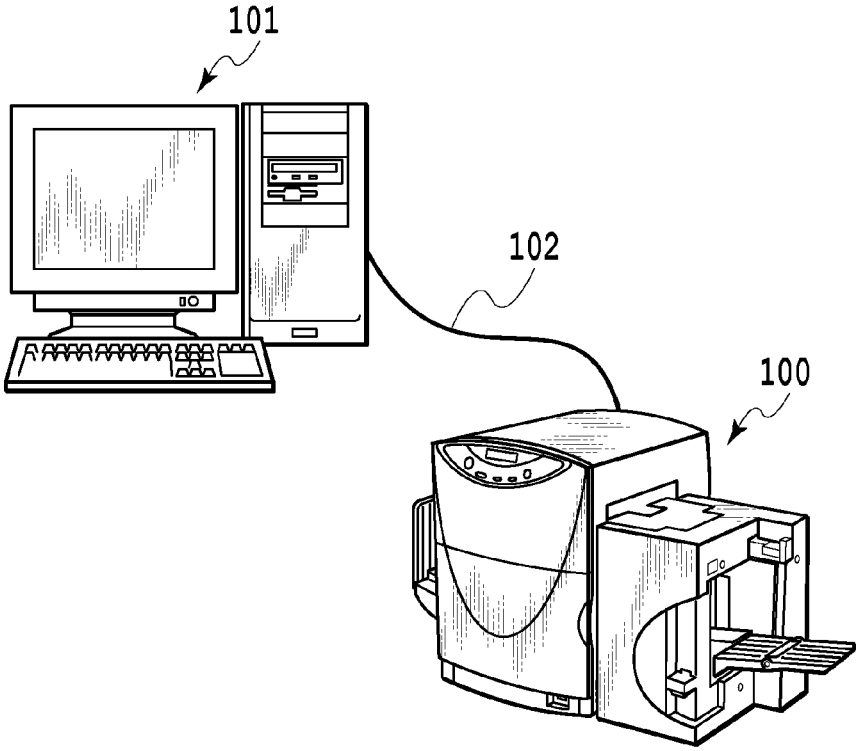
FIG. 1 is a schematic diagram illustrating a configuration of a printing system that includes an ink jet printing apparatus according to a first embodiment of the present invention.

FIG. 1 is a schematic diagram illustrating a configuration of a printing system that includes an ink jet printing apparatus (hereinafter referred to simply as a printing apparatus) 100 according to the present invention.

The printing apparatus 100 of this embodiment is a full-line type that can print a color image, as will be described later, and is connected to a host computer (a host apparatus) 101 by a printer cable 102. The printing apparatus 100 receives, via the printer cable 102, various data obtained by processing performed by the host apparatus 101, and begins the printing operation.

Figure 2:
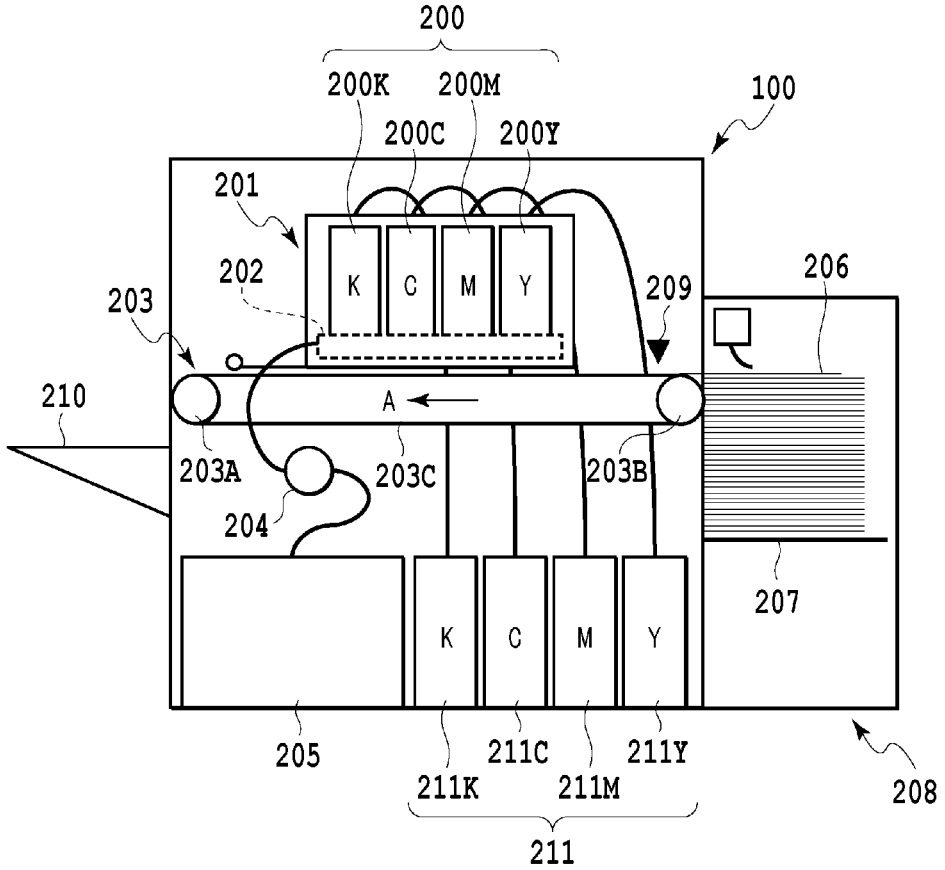
FIG. 2 is a schematic diagram showing an arrangement of the ink jet printing apparatus in FIG. 1.

FIG. 2 is a schematic diagram illustrating an arrangement of a primary section of the printing apparatus 100.

A print head unit 201 of the printing apparatus 100 includes print heads 200 (200K, 200C, 200M and 200Y) for ejecting black, cyan, magenta and yellow inks, respectively. These print heads 200 form an elongated line head where nozzle arrays are extended in a direction that crosses a direction (a direction indicated by an arrow A) in which a cut sheet 206 used as a printing medium is to be conveyed. For each of the print heads 200, the nozzle array is formed of a plurality of nozzles for ejecting ink, and is extended in a direction that crosses (in this embodiment, is perpendicular to) the direction in which the cut sheet 206 is to be conveyed. An ejection energy generating element, such as an electrothermal transducing element (a heater) or a piezoelectric element, is employed for ejecting ink. When the electrothermal transducing elements are employed, heat can be generated to form bubbles in ink, and the bubble energy can be employed to eject ink through ejection ports formed in the distal ends of the nozzles.

The printing apparatus 100 also includes a cap unit 202 for protecting the nozzles of the print heads 200 in a manner that will be described later, a pressure pump 204 used for performing a recovery process, such as suction-based recovery, and a waste ink tank 205 for storing waste ink. The cut sheets 206 are mounted on a feed tray 207 of a feeding unit 208, and are supplied, one by one, to a conveying unit 203. The conveying unit 203 conveys a cut sheet 206 in the conveying direction indicated by the arrow A. For the conveying unit 203 of this embodiment, a conveying belt 203C is extended between rollers 203A and 203B, and is to be moved by a conveying motor 203D, which will be described later, in the conveying direction indicated by the arrow A. A TOF sensor 209 detects a leading edge of the cut sheet 206 conveyed by the conveying unit 203, and the print heads 200 employ a detection signal of the TOF sensor 209 as a trigger for a sequential printing of images on the cut sheet 206. The cut sheet 206 on which images have been printed is discharged from a discharge port, and is stacked on a discharge tray 210.

Ink tanks 211 for storing black, cyan, magenta and yellow ink are provided as ink tanks 211K, 211C, 211M and 211Y. Ink in the ink tanks 211 is supplied by the pump 204 to the print heads 200 for corresponding colors. When a recovery process, including a suction-based recovery and a preliminary ejection, is performed for the print heads 200, the cap unit 202 accepts ink. Such an ink accepted in cap unit 202 is discharged, by suction, to the waste ink tank 205 by the pump 204.

Figure 3:
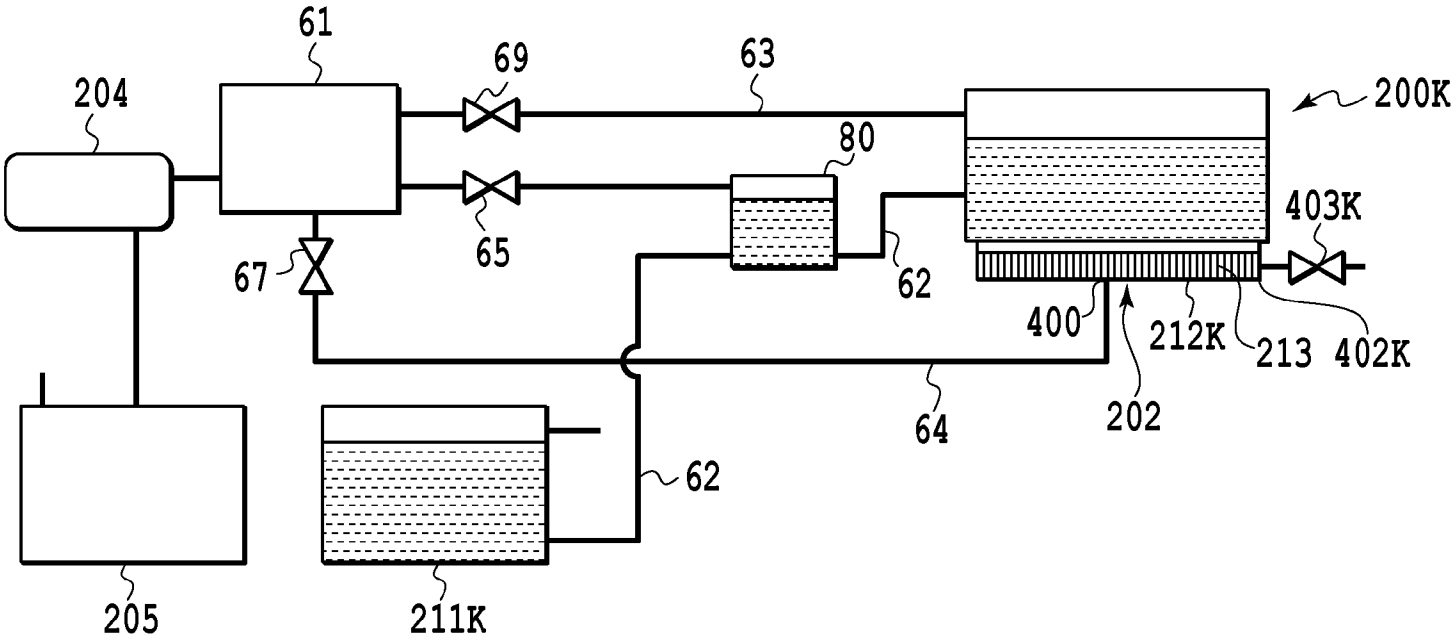
FIG. 3 is a diagram for explaining an ink supply system and an ink discharge system of the ink jet printing apparatus in FIG. 1.

FIG. 3 is a diagram for explaining an ink supply system and an ink discharge system, showing as a typical example, structures of the ink supply system and the ink discharge system for the print head 200K. However, the same ink supply system structure and the same ink discharge system structure are employed for the other print heads 200C, 200M and 200Y.

Ink in the ink tank 211K is supplied to the ink chamber of the print head 200K via an ink supply path 62, along which a gas-liquid separation tank 80 is located. A liquid level sensor (not shown) is provided for the ink chamber of the print head 200K, and when ink in the ink chamber reaches a predetermined level or lower, the pump 204 is driven in one direction, and introduces a negative pressure into the ink chamber via a buffer chamber 61, a valve 69 and a discharge path 63. It should be noted that the pump 204, the buffer chamber 61 and the valve 69 constitute the suction unit of the present invention. Upon applying the negative pressure, the ink in the ink tank 211K is supplied along the ink supply path 62 to the ink chamber of the print head 200K.

Figure 4:
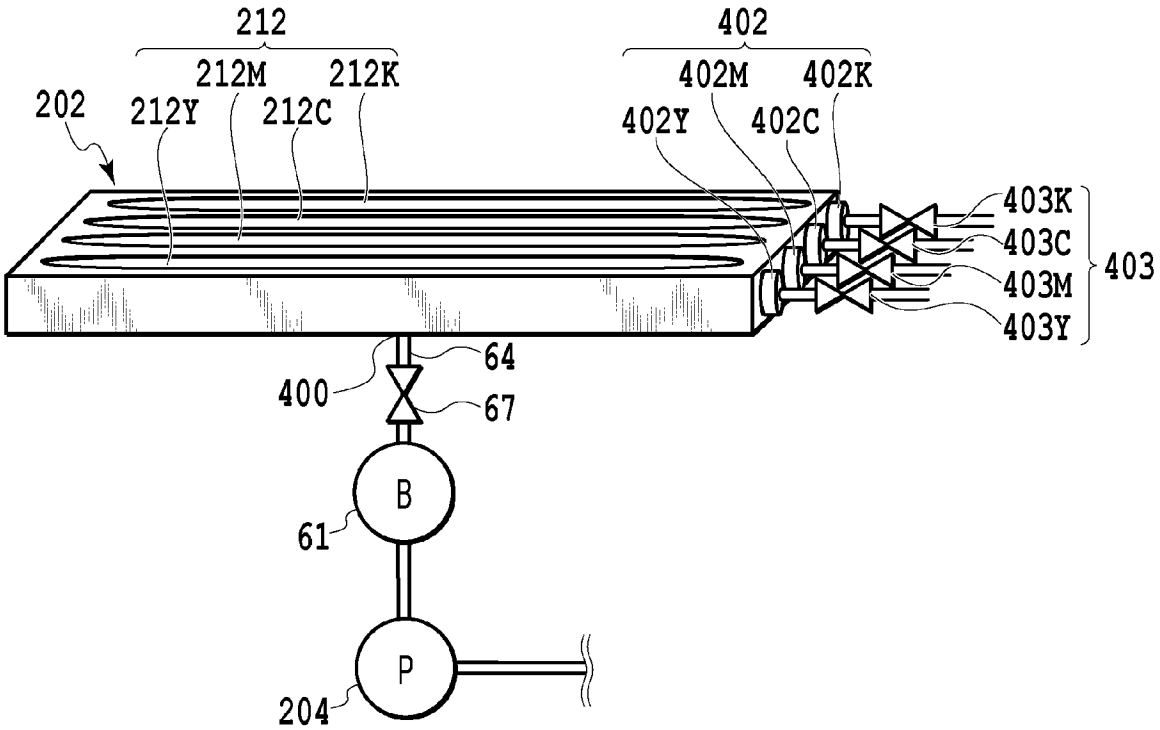
FIG. 4 is a schematic diagram illustrating a structure of a cap unit in FIG. 3.

As shown in FIG. 4, the cap unit 202 includes caps 212 (212K, 212C, 212M and 212Y) for covering (capping) the ejection port faces where the nozzles of the print heads 200 (200K, 200C, 200M and 200Y) are formed. Ink absorbers 213 are arranged in the individual caps 212, and air release ports (atmospheric communication portions) 402 (402K, 402C, 402M and 402Y) are formed for the caps 212 to connect the interior of the caps to the atmosphere. Further, air release valves 403 (403K, 403C, 403M and 403Y), which are to be opened or closed, are provided for the air release ports 402. The caps 212 are internally connected, in common, to one ink suction port 400, which is connected to the ink discharge path 64. For discharging ink from the caps 212, the pump 204 is driven in one direction to apply a suction force to the inside of the caps 212 via the buffer chamber 61, a valve (ink suction valve) 67, the ink discharge path 64 and the ink suction port 400. By applying the force of suction, waste ink remaining in the cap 212 is discharged to the waste ink tank 205. Furthermore, air in the gas-liquid separation tank 80 is discharged, by the pump 204, to the waste ink tank 205 via the valve 65 and the buffer chamber 61.

Figure 5:
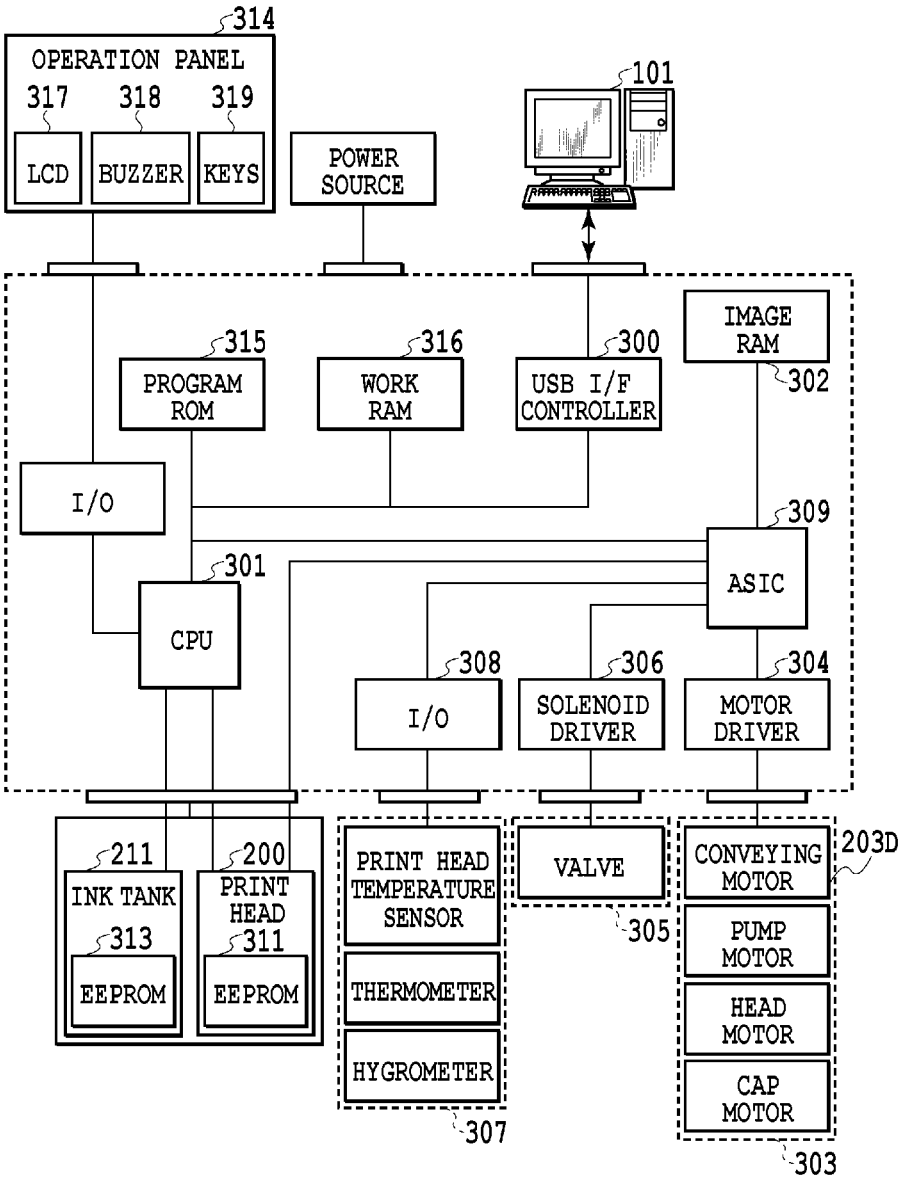
FIG. 5 is a block diagram illustrating an arrangement of a control system of the ink jet printing apparatus in FIG. 1.

FIG. 5 is a block diagram illustrating a control system for the printing apparatus 100.

The printing apparatus 100 of this embodiment employs a USB interface controller 300 to receive print data and commands from the host apparatus 101. A CPU (control unit) 301, which is a central processing unit, controls the overall operation of the printing apparatus 100, such as the reception of print data and the printing operation. Image data for the individual color components of the print data are to be loaded into an image RAM 302. A motor driver 304 drives various motors 303, such as the conveying motor 203D, a pump motor that drives the pump 204, a head motor that drives the print heads 200 and a cap motor that drives the caps 212. A solenoid driver 306 controls valves 305, including the valves 65, 67 and 69. An I/O 308 receives data from various sensors 307, including a temperature sensor, such as a head diode sensor, that detects the temperature of the print head 200, a thermometer that detects the environmental temperature, and a hydrometer that detects the environmental humidity. An ASIC 309 controls the entire printing apparatus 100 based on an instruction issued by the CPU 301, and causes the print heads 200 to eject ink, based on the data loaded into the image RAM 302, and to print an image on the cut sheet (printing medium) 206. The ASIC 309 serves as a cap cleaning controller for controlling cleaning of the caps 212, an air release port cleaning controller for controlling the cleaning of the air release ports 402, and a suction-based recovery controller for controlling the suction-based recovery process. These functions will be described later.

Each of the print heads 200 includes an EEPROM 311, for storing inherent data for the print head 200, and each of the ink tanks 211 includes an EEPROM 313 for storing inherent data for the ink tank 211. An operation panel 314, which is employed as an interface between the printing apparatus 100 and a user, includes an LCD 317 and a buzzer 318, used to notify a user of the state of the printing apparatus 100, and keys 319, which are employed by a user to enter an instruction for the printing apparatus 100.

The CPU 301 sequentially reads print data, for corresponding colors, from the image RAM 302, in synchronization with the detection of the cut sheet 206, and transmits the read data to the print heads 200. The CPU 301 performs a process program, which is stored in a program ROM 315, and exercises various types of control, including those for processes that will be described later, for the printing apparatus 100. In the program ROM 315, a process program and a table are stored in consonance with the control operation (flowchart in FIG. 6), which will be described later. Further, a work RAM 316 is employed as a work memory.

During the recovery process performed for the print heads 200, the CPU 301 monitors the sensors 307 and drives the various motors 303 via the motor driver 304, so as to either apply pressure to ink in the print heads 200 or to draw out ink using suction. Ink to be employed for the printing operation or for the recovery process is supplied from the corresponding ink tanks 211. An ID and a serial number, representing the color and type of a stored ink, are written to the EEPROMs 311 provided for the individual ink tanks 211, and a count value indicating the volume of ink consumed is also stored in order that the remaining amount of ink can be determined.

Figure 6:
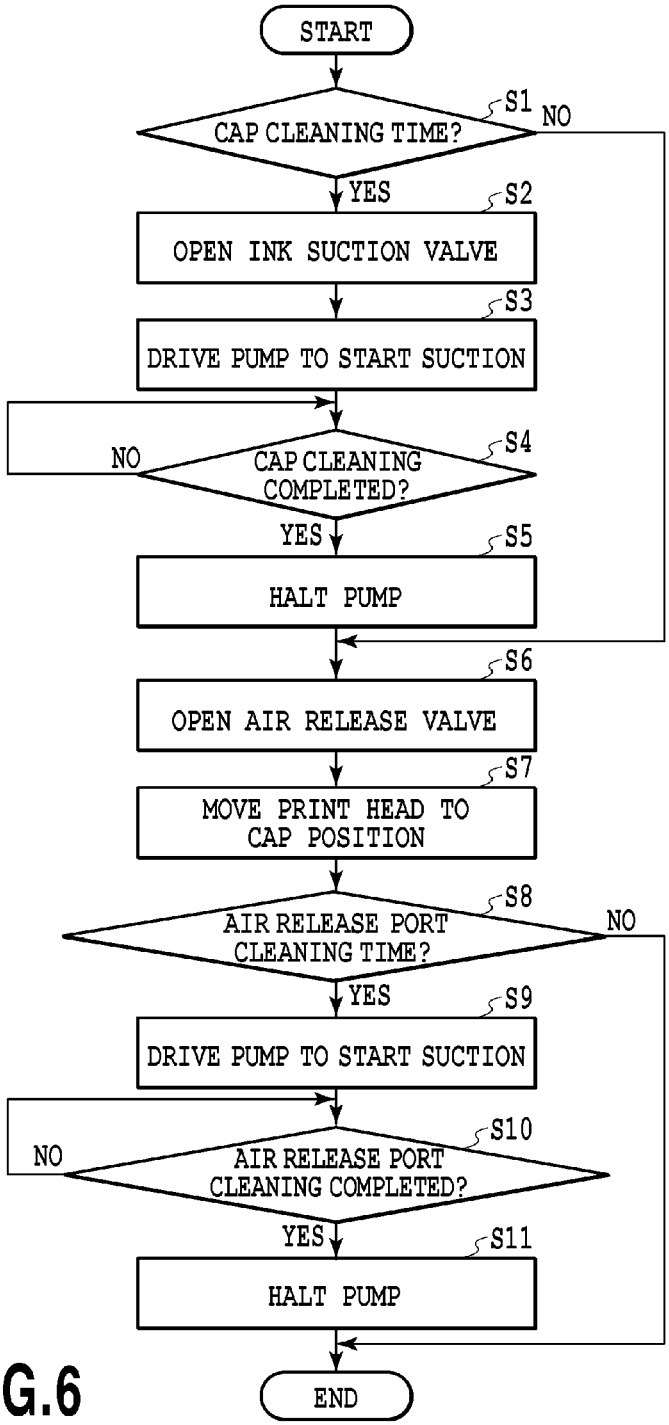
FIG. 6 is a flowchart for explaining a cleaning operation performed for the first embodiment of the present invention.

FIG. 6 is a flowchart for explaining a cleaning operation performed in this embodiment to clean the cap unit 202 (the cleaning operation performed to clean the caps 212 and the air release ports 402), and FIGS. 7A, 7B, 7C and 7D are diagrams for explaining processing steps as the cleaning operation progressed. In this embodiment, the cleaning operation (ink discharge operation; third operation) is performed at the same time for all of the caps 212 (212K, 212C, 212M and 212Y). Also, the cleaning operation (ink discharge operation; second operation) is performed at the same time for all of the air release ports 402 (402K, 402C, 402M and 402Y).

Figure 7A:
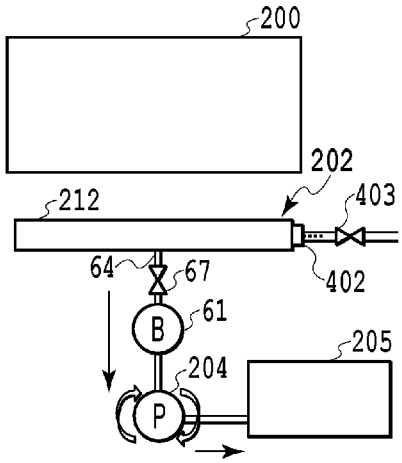
FIGS. 7A to 7D are diagrams for explaining individual states during the progression of the cleaning operation in FIG. 6.

When the printing apparatus 100 has completed the printing operation, the CPU 301 causes the cap motor to move the cap unit 202 to the preparation position, as shown in FIG. 7A, whereat the caps 212 prepare to cover the print heads 200. At this time, the CPU 301 determines whether a cleaning time for the caps 212 of the cap unit 202 has arrived (step S1). In this embodiment, the preliminary ejection of ink is performed for all of the four caps 212. Therefore, the CPU 301 employs a first counter, connected to the CPU 301 and provided for the printing apparatus 100, to obtain volume information (second volume information) that corresponds to the total number of ink droplets ejected to at least one of the caps 212 during the preliminary ejection. Thereafter, based on the count value, i.e., based on the second volume information that corresponds to the volume of ink used for the preliminary ejection, the CPU 301 determines whether the cleaning time for all of the caps 212 has arrived. Specifically, the CPU 301 compares, with a first specified value (second predetermined volume), the total number of ink droplets ejected to one cap 212 for the preliminary ejection (the count value obtained by the first counter). When the count value obtained by the first counter exceeds the first specified value, i.e., when the volume of ink ejected into the cap 212 for the preliminary ejection is a predetermined volume or more, the CPU 301 ascertains that the cleaning time for all of the caps 212 has arrived. When the cleaning time for the caps has not arrived yet, program control is shifted to step S6, which will be described later. The first specified value can be set in accordance with the form of a cap, for example, in order to determine an appropriate cap cleaning time.

When the cleaning time of the caps has arrived, first, as shown in FIG. 7A, the CPU 301 opens the ink suction valve 67 in a state where the print heads 200 are not covered with the caps 212, and the print heads 200 and the caps 212 are located at distance from each other (step S2). The CPU 301 drives the pump 204 (step S3) to discharge ink, by suction, from the caps 212 to the waste ink tank 205, and clean the caps 212 (third operation). At this time, all the air release valves 403 (403K, 403C, 403M and 403Y) are closed. The CPU 301 continues to drive the pump 204 until the completion condition for the cap cleaning has been established (step S4). In this embodiment, the cap cleaning completion condition is sequential driving of the pump 204 for thirty seconds, and after the pump 204 has been driven for thirty seconds, the CPU 301 halts the pump 204 (step S5). In this manner, a suction process is collectively performed for all the caps 212 for a predetermined period of time.

Figure 7B:
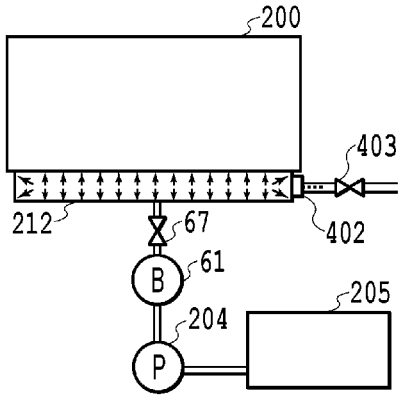

When all the caps 212 have been cleaned, the CPU 301 opens the air release valves 403 (step S6). Thereafter, as shown in FIG. 7B, the CPU 301 employs the head motor and moves the print heads 200 to a capping position to cover the print heads 200 with the caps 212, and clears the count value held by the first counter (step S7). Clearing of the count value held by the first counter should be performed, during a period following the performance of the determination at step S1, until the process at step S11 has been completed and all the processing has been terminated. At this time, the moving of the cap unit 202, or the moving of both the print heads 200 and the cap unit 202, may also be performed, so long as, in the long run, the caps 212 cover the print heads 200 at the capping position.

After the print heads 200 have been covered with the caps 212, the CPU 301 determines whether a cleaning time for the air release ports 402 of the cap unit 202 has arrived (step S8). In this embodiment, the preliminary ejection of ink is performed in the same manner for all the four caps 212. Therefore, volume information (first volume information) that corresponds to the total number of ink droplets ejected into at least one cap 212 for the preliminary ejection is counted by a second counter (connected to the CPU 301 of the printing apparatus 100), which is different from the first counter. Based on the obtained count value, i.e., based on the first volume information that corresponds to the volume of ink employed for the preliminary ejection, the CPU 301 determines whether the cleaning time for all of the air release ports 402 has arrived. Specifically, the CPU 301 compares, with a second specified value (first predetermined volume), the total number of ink droplets ejected into one cap 212 for the preliminary ejection (count value obtained by the second counter). When the count value obtained by the second counter exceeds the second specified value, the CPU 301 ascertains that the cleaning time for all of the air release ports 402 has arrived. When the cleaning time for the air release ports 402 has not yet arrived, the processing in FIG. 6 is terminated. The second specified value can be set in accordance with the form of a cap, for example, in order to determine an appropriate cleaning time for the air release ports 402, and may be either the same as, or different from, the first specified value. When the second specified value is the same value as the first specified value, only one counter is required to count the information that corresponds to the total number of ejected ink droplets. When the second specified value is set greater than the first specified value, the frequency for the cleaning of the air release ports 402 can be lower than the frequency for the cap cleaning operation.

Figure 7C:
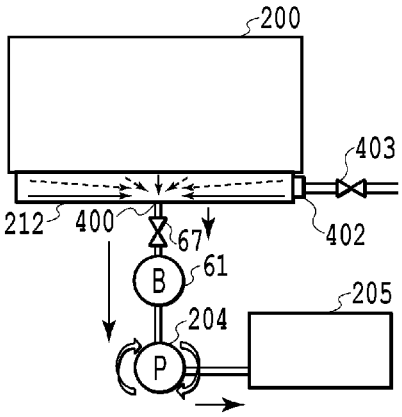

When the cleaning time for the air release ports 402 has arrived, as shown in FIG. 7C, the CPU 301 drives the pump 204, while maintaining a state where the print heads 200 are covered by the caps 212, and the air release ports 402 and the ink suction valve 67 are open (step S9). At this time, the openings of the caps 212 are blocked by the ejection port faces of the print heads 200 so as to form a closed space, except for the portions of the air release ports 402. Therefore, as shown in FIG. 7C, when the pump 204 is driven, ink is removed from the air release ports 402 by suction (second operation). The negative pressure introduced into the caps 212 during the cleaning operation of the air release ports 402 is smaller than the negative pressure introduced into the caps 212 during the suction-based recovery of the print heads 200. That is, the negative pressure applied during the cleaning operation for the air release ports 402 is set at a level at which the meniscus of ink is maintained at the ejection ports of the nozzle tips. The lowering of a negative pressure indicates a decrease in the absolute value of a pressure that is lower than that of the atmosphere.

The suction-based recovery is a recovery process, during which negative pressure is applied to the cap 212 so as to suck and discharge ink, not contributing to image printing, from the nozzles of the print heads 200 into the caps 212. In the suction-based recovery operation (first operation), first, the print heads 200 are covered with the caps 212. Then, in the state where the valves 69, 65 and 67 and the air release valves 403 are closed, the CPU 301 drives the pump 204 for a predetermined period of time to increase the negative pressure inside the buffer chamber 61. Thereafter, the CPU 301 halts the pump 204 and opens the valve 67 to apply the negative pressure in the buffer chamber 61 to the ejection ports of the print heads 200. As a result, ink not contributing to image printing is sucked and discharged from the nozzles of the print heads 200 into the caps 212.

As for the cleaning operation for the air release ports 402 (second operation), the CPU 301 drives the pump 204 in the state where the valves 69 and 65 are closed and the valve 67 and the air release valves 403 are open. As a result, the negative pressure smaller than that for the suction-based recovery is applied to the ejection ports of the print heads 200. As described above, during the air release port cleaning operation, the suction force (second suction force) exerted at the caps 212 is smaller than the suction force (first suction force) applied for the suction-based recovery. Therefore, ink in the air release ports 402 can be drawn out by suction, while the meniscus of ink at the ejection ports of the nozzle tips are maintained. At this time, ink can be drawn out from the tubes extended between the air release ports 402 and the air release valves 403, and from the air release valves 403. Further, a pump that can apply different pressures may be employed as a method for exerting different negative pressures on the print heads 200 for the suction-based recovery operation, and for the cleaning operation of the air release ports 402. Further, so long as the negative pressure applied to the ejection ports of the print heads 200 for the cleaning operation of the air release ports 402 is smaller than the negative pressure applied for the suction-based recovery, a negative pressure may be employed at a level at which the meniscus of ink at the ejection ports is not maintained. In this case, ink may leak from the ejection ports; however, the volume of ink leakage at the ejection ports can be reduced less than in a case where the air release ports 402 are cleaned by applying the negative pressure that is employed for the suction-based recovery.

Figure 7D:
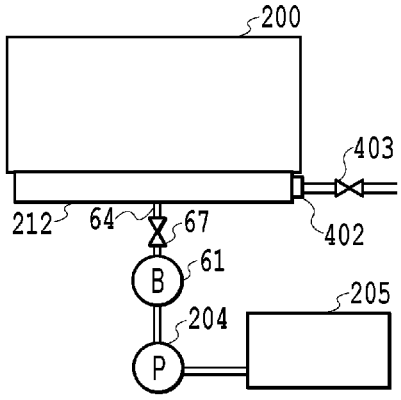

In a case where air in the caps 212 is inflated, as indicated by arrows in FIG. 7B, by the heat of the print heads 200, the inflated air, and ink that has been pushed into the air release ports 402 by the inflation of the air, are discharged. The CPU 301 drives the pump 204 until the completion condition for the cleaning of the air release ports 402 has been established (step S10). In this embodiment, the completion condition for the cleaning of the air release ports 402 is the sequential driving of the pump 204 for fifteen seconds. When the pump 204 has been driven for fifteen seconds, the CPU 301 halts the pump 204, as shown in FIG. 7D, and clears the count value held by the second counter (step S11). Clearing of the count value held by the second counter should be performed during a period following the performance of the determination at step S8 until the process at step S11 has been completed and all the processing has been terminated. Since the ink suction valve 67 is open in the state in FIG. 7D, when the air in the caps 212 is inflated, the pressure can be released through the ink discharge path 64.

As described above, the cleaning operation for the air release ports 402 is performed by opening the air release ports 402 and covering the print heads 200 with the caps 212, and by discharging ink from the air release ports 402 by employing the force of the suction provided by the pump 204, while the capping state is maintained. Therefore, ink in the air release ports 402 can be appropriately discharged, by suction, through the closed space at the caps 212.

When the caps 212 and the air release ports are cleaned in the above described manner, the leakage of ink to the outside via the air release ports 402 can be prevented. In a case where a predetermined amount of ink or more is retained in a cap 212, when the print head 200 is moved to the cap location, as shown in FIG. 7B, the air in the cap 212 may be inflated by the heat of the print head 200, and due to the inflation of the air, ink retained in the air release port 402 may be forced out. In this embodiment, as described above, since the pump 204 is driven in the state where the air release valves 403 are open, air inflated in the caps 212 and ink retained in the air release ports 402 can be removed, by suction, as shown in FIG. 7C. In this embodiment, the CPU 301 employs the count value obtained by the second counter, and determines whether the cleaning time for the air release ports 402 has arrived; however, the method employed for the present invention is not limited to this. The count value for the number of sheets printed by the print head 200 since the previous cleaning time may be examined to determine whether the count value is a predetermined value or more, or is smaller than the predetermined value, and the obtained results may be employed to determine whether the cleaning time for the air release ports 402 has arrived. In this case, when the count value of the number of sheets is the predetermined value or greater, the CPU 301 causes the cleaning operation to be performed for the air release ports 402, but when the count value is smaller than the predetermined value, the CPU 301 does not perform the cleaning operation for the air release ports 402.

(Second Embodiment)

Figure 8:
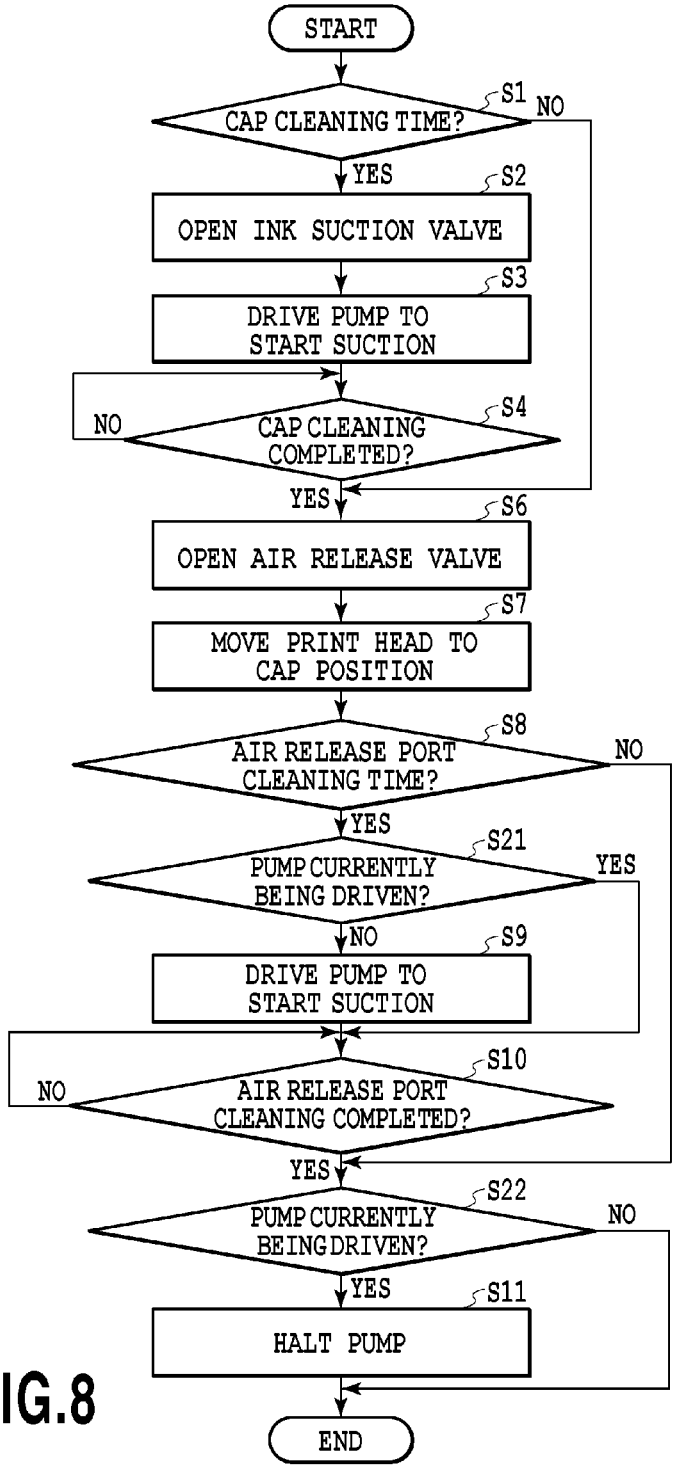
FIG. 8 is a flowchart for explaining a cleaning operation performed for a second embodiment of the present invention.

FIG. 8 is a flowchart for explaining the ink discharge operation for the cap unit according to a second embodiment of the present invention, and to avoid redundant explanations, the same step numbers are provided for the same processes as in FIG. 6, for the previous embodiment.

In the previous embodiment, at step S4, the CPU 301 determines the cap cleaning has been completed, and at step S5, halts the pump 204 and, thereafter, advances the processing to the next step S6. In this embodiment, however, when the processing proceeds from step S4 to step S6, the CPU 301 does not halt the pump 204. Further, when the CPU 301 ascertains, at step S8, that the cleaning time for the air release ports 402 has arrived, the CPU 301 determines whether the pump 204 is currently being driven (step S21). When the pump 204 is not being driven, at step S9 the CPU 301 begins the driving of the pump 204, and moves to step S10. When the pump 204 is currently being driven, the CPU 301 performs the processing so as to pass step S9 and jump to step S10. Further, before the CPU 301 halts the pump 204 at step S11, the CPU 301 determines whether the pump 204 is still being driven (step S22). When the pump 204 is currently being driven, the CPU 301 performs the process of step S11 to halt the pump 204, or, when the pump 204 has already been halted, the processing in FIG. 8 is terminated.

As described above, in this embodiment, as shown in FIG. 7A, the CPU 301 drives the pump 204 to clean the caps 212, and moves the print heads 200 to the cap position, as shown in FIG. 7B, while maintaining the driving of the pump 204. Therefore, when cleaning time for the air release ports 402 has arrived, the negative pressure can be applied to the caps 212 immediately by moving the print heads 200 to the cap position, and cleaning of the air release ports 402 can be quickly performed.

(Third Embodiment)

In the first and second embodiments described above, the time to start the cleaning operation for the air release ports 402 is determined based on the total number of ink droplets ejected into the caps 212 for the preliminary ejection. In this embodiment, as will be described later, the temperature of the print head 200 and the environmental temperature are employed to control the cleaning operation for the air release ports 402. As a result, a more appropriate period for driving the pump 204 can be set, and the throughput is improved.

Figure 9:
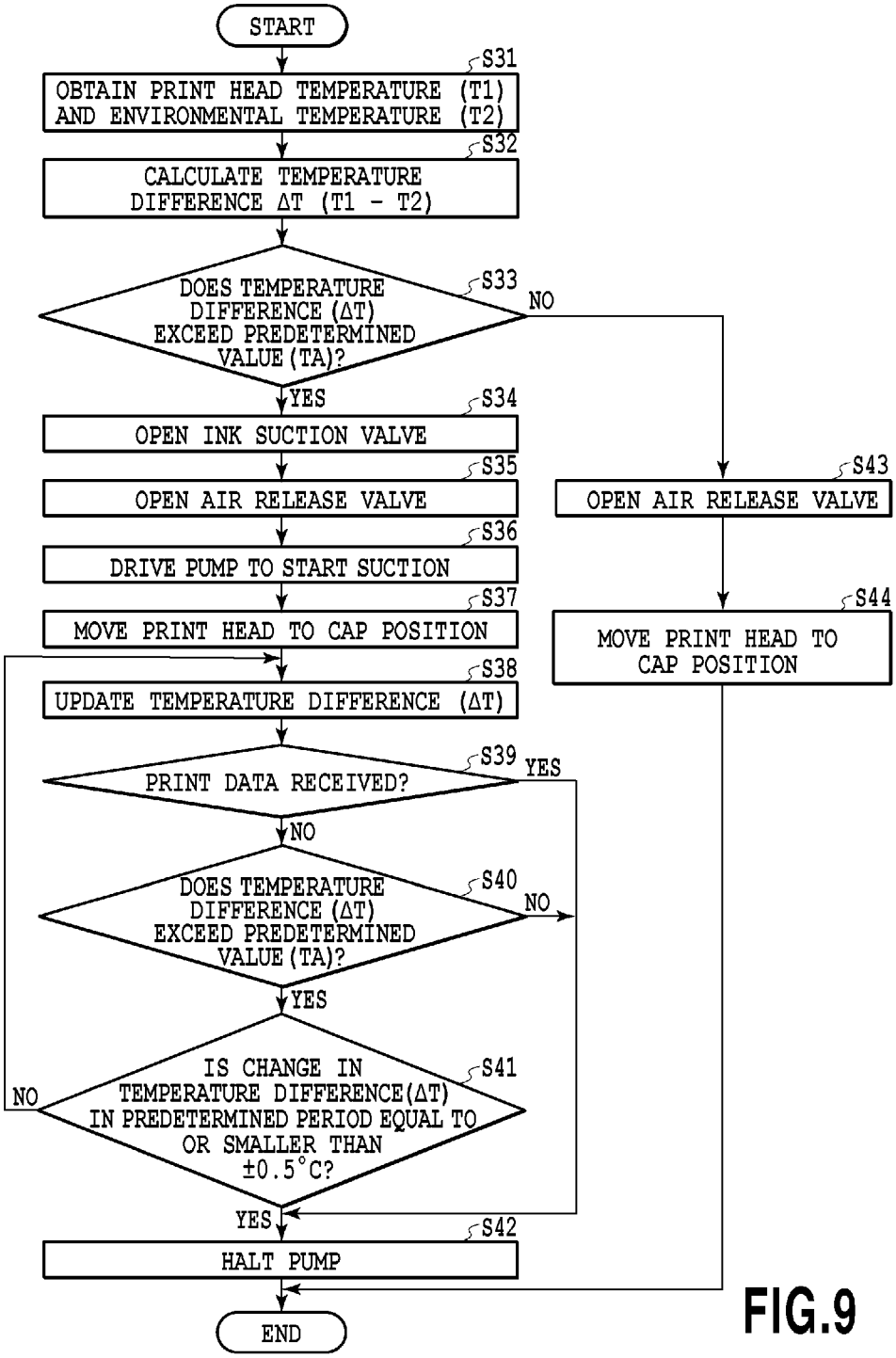
FIG. 9 is a flowchart for explaining a cleaning operation performed for a third embodiment of the present invention.

FIG. 9 is a flowchart for explaining the cap unit cleaning operation according to this embodiment. In this embodiment, the cleaning operation for all of the air release ports 402 (402K, 402C, 402M and 402Y) will be performed at the same time.

After the printing operation by the printing apparatus 100 has been completed, the CPU 301 obtains a temperature T1 of the print head 200 and an environmental temperature T2 for the printing apparatus 100 (step S31). The temperature T1 may be the highest of the temperatures of all the print heads 200 (200K, 200C, 200M and 200Y). The temperature T1 may be a temperature for a print head 200 that is most frequently employed. The temperature T1 and the environmental temperature T2 are detected by a temperature sensor for the print head 200 and a thermometer for the environmental temperature, both of which are included in the various sensors 307 in FIG. 5. The CPU 301 calculates a temperature difference ΔT (T1−T2) between the temperatures T1 and T2 (step S32), and determines whether the temperature difference ΔT exceeds a predetermined value TA (step S33).

The temperature difference ΔT and the volume of air inflated in the cap 212 are proportional to each other. When the print head 200, for which the temperature difference ΔT is greater than a predetermined temperature, is covered with the cap 212, air in the cap 212 is inflated, and pushes ink from the cap 212 toward the air release port 402, and further, thereafter, the ink may leak outside. In this embodiment, it is assumed that when the temperature difference ΔT exceeds 10° C., the outside leakage of ink from the air release port 402 may occur, and 10° C. is set as the predetermined value TA.

When the temperature difference ΔT is equal to or smaller than the predetermined value TA, the CPU 301 opens the air release valve 403 (step S43), and moves the print head 200 to the cap position (step S44) and terminates the processing in FIG. 9.

When the temperature difference ΔT is greater than the predetermined value TA, the CPU 301 opens the ink suction valve 67 and the air release valve 403 (steps S34 and S35), and begins to drive the pump 204 (step S36). Thereafter, the CPU 301 moves the print head 200 to the cap position to cover the print head 200 with the cap 212 (step S37). Since the driving of the pump 204 is continued for a period until the print head 200 has been moved to the cap position, in such a period, ink in the cap 212 can be drawn out to perform cap cleaning.

Following this, the CPU 301 updates the temperature difference ΔT (step S38), and based on the first, second and third halt conditions, determines the time for halting the pump 204.

The first halt condition is that print data employed for the succeeding printing operation should be received. When such print data is received, the CPU 301 moves the processing from step S39 to step S42 to halt the pump 204. The first halt condition is so designated because, when the print data is received, the print heads 200 are moved away from the caps 212 in order to begin printing and air in the caps 212 will not be inflated, and therefore, it can be ascertained that leakage of ink from the air release ports 402 does not occur. The second halt condition is that the temperature difference ΔT should be equal to or smaller than the predetermined value TA. When the temperature difference ΔT is equal to or smaller than the predetermined value TA, the CPU 301 moves the processing from step S40 to step S42 to halt the pump 204. The second halt condition is so designated because, as previously described, it can be ascertained that the leakage of ink does not occur when the temperature difference ΔT is equal to or smaller than the predetermined value TA (equal to or lower than a targeted predetermined temperature). The third halt condition is that a change in the temperature difference ΔT within a predetermined unit time is equal to or smaller than ±0.5° C., and when this condition is established, the CPU 301 advances the processing from step S41 to S42 to halt the pump 204. The third halt condition is so designated because, when the change in the temperature difference ΔT within the predetermined period of time is equal to or smaller than ±0.5° C., the air in the cap 212 is inflated at a moderate speed with a very small inflated volume, and therefore, it can be ascertained that the leakage of ink does not occur.

When one of the first, second and third halt conditions has been established, the CPU 301 halts the pump 204 (step S42). That is, the driving of the pump 204 continues during a period lasting until the first, the second or the third halt condition has been established.

As described above, when the cap unit 202 is cleaned and the air inflated in the caps 212 is drawn out by suction through the ink suction port 400, the leakage of ink from the air release ports 402 to the outside can be prevented.

FIG. 10 is a diagram for explaining an example change in the temperature difference ΔT after the capping has been performed at step S37. In this embodiment, immediately after the capping at step S37 has been performed while the driving of the pump 204 is continued, the temperature difference ΔT is 36° C., and is reduced in accordance with the elapse of time. When seventeen seconds has elapsed, the temperature difference ΔT is 10° C., and at this time, the CPU 301 advances the processing from step S41 to step S42 to halt the pump 204.

Further, in a case where the environmental temperature T2 is stabilized within a predetermined range, the CPU 301 may perform the processes at steps S34 to S37 when the temperature T1 of the print head 200 exceeds a predetermined temperature TB. In this case, at step S38, the temperature T1 for the print head 200 is updated, and the pump 204 is halted under the condition that that print data employed for the succeeding printing operation should be received (the above described first halt condition), and the condition that the temperature T1 be equal to or lower than the predetermined temperature TB (a halt condition).

(Fourth Embodiment)

In the embodiments described above, the cleaning operation is collectively performed for all the caps 212 (212K, 212C, 212M and 212Y), and also, the cleaning operation is collectively performed for all the air release ports 402 (402K, 402C, 402M and 402Y). However, the cleaning operation may be separately performed for the caps 212 (212K, 212C, 2121M and 212Y), and the cleaning operation for the air release ports 402 (402K, 402C, 402M and 402Y) also may be individually performed.

For example, the ink suction ports 400 are respectively provided for the caps 212K, 212C, 212M and 212Y, and are connected to the pump 204 that is used in common via the ink suction valves 67 provided individually. The ink suction valves 67 and the air release valves 403K, 403C, 403M and 403Y are independently opened or closed. As a result, individual cleaning can be performed for the caps 212K, 212C, 212M and 212Y, and individual cleaning for the air release ports 402K, 402C, 402M and 402Y can be performed.

More specifically, in the first and second embodiment, a process is performed so as to eject inks for the preliminary ejection, indifferent total numbers, into the caps 212K, 212C, 212M and 212Y. Based on these ink droplet numbers, the CPU 301 determines the cleaning timings for the individual caps, and performs the cleaning operation for the caps. Similarly, based on the ink droplet numbers, the CPU 301 determines the cleaning timings for the individual air release ports 402K, 402C, 402M and 402Y, and performs the cleaning operation for these air release ports.

Furthermore, in the third embodiment, a process may be performed so that a difference between the temperature T1, of the print head 200K, 200C, 200M or 200Y, and the environmental temperature T2 is employed to calculate a temperature difference ΔT for each print head 200. Based on the temperature difference ΔT of each print head 200, the cleaning operation for the air release ports 402K, 402C, 402M and 402Y can be performed.

(Other Embodiment)

In the above described embodiments, the time for performing the cleaning operation for the air release port is designated based either on the total number of ink droplets ejected into the cap for the preliminary ejection, or the temperature of the print head. However, each time the print head is covered with the cap, the cleaning for the air release port may be performed. Further, in the third embodiment, when the shape of the cap is changed, or the performance of the pump is improved, the cap cleaning operation can be eliminated.

Furthermore, the present invention is applied not only for a full-line type inkjet printing apparatus described above, but also for various other types of ink jet printing apparatuses. For example, the present invention can be applied for a serial scan type ink jet printing apparatus that prints an image by moving a print head in the main scan direction and conveying a printing medium in the sub-scan direction across the main scan direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-006277, filed Jan. 17, 2013, which is hereby incorporated by reference herein in its entirety.

What is claimed is:

1. An ink jet printing apparatus that prints an image on a printing medium by employing a print head capable of ejecting ink from ejection ports, comprising:

a cap configured to cover the ejection ports;

a valve configured to open and close an atmospheric communicating portion that communicates an inside of the cap and the atmosphere;

a change unit configured to change a relation between the print head and the cap to a first state where the cap covers the ejection ports or a second state where the cap does not cover the ejection ports;

a suction unit configured to generate a suction force; and a control unit configured to perform an operation where the suction unit applies the suction force to the inside of the cap in the first state where the cap covers the ejection ports and the valve opens the atmospheric communicating portion, the suction force being set at a level at which meniscuses of ink are maintained at the ejection ports, wherein the control unit causes the change unit to change the relation to the second state and causes the valve to open the atmospheric communicating portion, and subsequently, while keeping the valve open, causes the change unit to change the relation to the first state and performs the operation.

2. The ink jet printing apparatus according to claim 1, wherein, in the operation, the control unit causes the suction unit to apply the suction force to the inside of the cap from the second state before the cap covers the ejection port.

3. The ink jet printing apparatus according to claim 1, wherein in the operation, the control unit causes the suction unit to apply the suction force to the inside of the cap until a temperature difference between a temperature of the print head and an environmental temperature is equal to or lower than a predetermined temperature.

4. The ink jet printing apparatus according to claim 1, wherein in the operation, the control unit causes the suction unit to apply the suction force to the inside of the cap until a change, within a unit of time, of a temperature difference between a temperature of the print head and an environmental temperature is equal to or lower than a predetermined temperature.

5. The ink jet printing apparatus according to claim 1, wherein in the operation, the control unit causes the suction unit to apply the suction force to the inside of the cap until a temperature of the print head is equal to or lower than a predetermined temperature.

6. The ink jet printing apparatus according to claim 1, wherein in the operation, the control unit causes the suction unit to apply the suction force to the inside of the cap for a predetermined period of time.

7. The ink jet printing apparatus according to claim 1, wherein the cap accepts ink ejected from the ejection ports for a preliminary ejection.

8. The ink jet printing apparatus according to claim 7, wherein in the operation, the control unit causes the suction unit to apply the suction force to the inside of the cap, under a condition that volume information corresponding to a volume of ink ejected to the cap for the preliminary ejection indicates a predetermined volume or more.

9. The ink jet printing apparatus according to claim 7, wherein the control unit performs the operation under a condition that volume information corresponding to a volume of ink ejected into the cap for the preliminary ejection indicates a predetermined volume or more.

10. The ink jet printing apparatus according to claim 7, wherein the control unit performs the operation under a condition that first volume information corresponding to a volume of ink ejected into the cap for the preliminary ejection indicates a volume greater than a first predetermined volume, and the control unit performs a cap cleaning operation different from the operation where the suction unit applies the suction force to the inside of the cap in the second state where the print head and the cap are separated from each other under a condition that second volume information corresponding to a volume of ink ejected into the cap for the preliminary ejection indicates a volume greater than a second predetermined volume that is smaller than the first predetermined volume.

11. An ink jet printing apparatus that prints an image on a printing medium by employing a print head capable of ejecting ink from ejection ports, comprising:

a cap configured to cover the ejection ports;

a valve configured to open and close an atmospheric communication portion that communicates an inside of the cap and the atmosphere;

a change unit configured to change a relation between the print head and the cap to a first state where the cap covers the ejection ports or a second state where the cap does not cover the ejection ports;

a suction unit configured to generate a suction force; and a control unit configured to perform an operation where the suction unit applies the suction force to the inside of the cap in the first state where the cap covers the ejection ports and the valve opens the atmospheric communication portion, wherein the control unit causes the change unit to change the relation to the second state and causes the valve to open the atmospheric communicating portion, and subsequently, while keeping the valve open, causes the change unit to change the relation to the first state and performs the operation.

* * * * *